US008363875B2

(12) United States Patent
Ito et al.

(10) Patent No.: US 8,363,875 B2
(45) Date of Patent: Jan. 29, 2013

(54) HEADPHONE

(75) Inventors: Tomohiro Ito, Tokyo (JP); Mitsuyoshi Taniguchi, Chiba (JP)

(73) Assignee: Sony Corporation, Tokyo (JP)

( * ) Notice: Subject to any disclaimer, the term of this patent is extended or adjusted under 35 U.S.C. 154(b) by 588 days.

(21) Appl. No.: 12/353,010

(22) Filed: Jan. 13, 2009

(65) Prior Publication Data

US 2009/0185705 A1 Jul. 23, 2009

(30) Foreign Application Priority Data

Jan. 17, 2008 (JP) ..... P2008-008374

(51) Int. Cl.
*H04R 25/00* (2006.01)

(52) U.S. Cl. ..... 381/379

(58) Field of Classification Search ..... 381/379
See application file for complete search history.

(56) References Cited

U.S. PATENT DOCUMENTS

| | | | | |
|---|---|---|---|---|
| 2,434,251 | A * | 1/1948 | Warnke | 381/379 |
| 4,065,645 | A | 12/1977 | Warner et al. | |
| 4,189,788 | A * | 2/1980 | Schenke et al. | 2/209 |
| 4,409,442 | A * | 10/1983 | Kamimura | 381/383 |
| 4,455,457 | A * | 6/1984 | Akira | 181/141 |
| 4,472,607 | A * | 9/1984 | Houng | 181/18 |
| 4,499,593 | A * | 2/1985 | Antle | 381/378 |
| 4,588,868 | A * | 5/1986 | Bertagna et al. | 381/382 |
| 4,689,822 | A * | 8/1987 | Houng | 381/379 |
| 5,033,094 | A * | 7/1991 | Hung | 381/379 |
| 5,117,464 | A * | 5/1992 | Jones et al. | 381/379 |
| 5,117,465 | A * | 5/1992 | MacDonald | 381/379 |
| 5,590,213 | A * | 12/1996 | Urella et al. | 381/370 |
| 6,724,906 | B2 * | 4/2004 | Naksen et al. | 381/379 |

FOREIGN PATENT DOCUMENTS

| | | |
|---|---|---|
| JP | 57-48779 | 3/1982 |
| JP | 62-053889 | 4/1987 |
| JP | 6-38286 | 2/1994 |
| JP | 08-256390 | 10/1996 |
| JP | 10-19090 | 1/1998 |
| JP | 10-191490 | 7/1998 |

(Continued)

OTHER PUBLICATIONS

European Search Report in corresponding application No. EP 08 25 3943 (Jul. 6, 2009).

(Continued)

*Primary Examiner* — Jeremy Luks
(74) *Attorney, Agent, or Firm* — Finnegan, Henderson, Farabow, Garrett & Dunner, L.L.P.

(57) ABSTRACT

There is provided a headphone having a pair of units being attached to both ends of a band, and at least one of the units being made slidable relative to the band. The headphone comprises a slider that supports the unit, accommodates a part of a cord for connecting end parts of the band and the unit, and includes an engaged part for regulating a sliding range of the unit, a slider guide fixed to an end part of the band and inserted through the slider, for guiding a sliding motion of the slider in the sliding motion of the unit, and an engaging part having approximately the same width as that of the engaged part, attached to the end part of the band, and engaged with the engaged part so as to be locked to the end part of the engaged part in the sliding motion of the unit.

21 Claims, 10 Drawing Sheets

FOREIGN PATENT DOCUMENTS

| | | | | |
|---|---|---|---|---|
| JP | 10-200981 | | | 7/1998 |
| JP | 11252681 | A | * | 9/1999 |
| JP | 2001-152730 | | | 6/2001 |
| JP | 2004-096792 | | | 3/2004 |
| JP | 2007-64280 | | | 3/2007 |

OTHER PUBLICATIONS

Notification of Reasons for Refusal issued Dec. 15, 2009, from the Japanese Patent Office in corresponding Japanese Patent application No. 2008-008374.

* cited by examiner

HEADPHONE

CROSS REFERENCES TO RELATED APPLICATIONS

The present invention contains subject matter related to Japanese Patent Application JP 2008-8374 filed in the Japan Patent Office on Jan. 17, 2008, the entire contents of which being incorporated herein by reference.

BACKGROUND OF THE INVENTION

1. Field of the Invention

The present invention relates to a headphone.

2. Description of the Related Art

In recent years, a custom to listen to music at any time and place has been spread, particularly among young people. Therefore, action such as listening to the music while performing other actions in a state of wearing a headphone is generally performed.

Meanwhile, the headphone of the following type is generally used. Namely, right and left pair of headphone units (called simply "units" hereafter) are provided at both ends of a band such as a headband, neckband, and under chin band, and a cord is led out from both units. Then, when other action is performed in a state of wearing this kind of headphone, the action is interrupted by contact between the cord and a body, and further a wearing state of the headphone is changed, thus involving an issue that a user is troubled by detachment of the headphone in some cases.

In order to solve the above-described issue, as shown in Japanese Patent Application Laid-Open No. 08-256390, for example, the headphone of the following type is also put to practical use. Namely, instead of leading out the cord from both units, the cord is inserted through the band, and the cord is led out only from one of the units. Note that the headphone similar to the above headphone is also disclosed in Japanese Patent Application Laid-Open No. 10-191490, Japanese Patent Application Laid-Open No. 10-200981, and Japanese Patent Application Laid-Open No. 2004-96792.

SUMMARY OF THE INVENTION

However, usually, in order to ensure an area for accommodating a cord connecting both units, the size and weight of a band and units are increased. Particularly, when a sliding mechanism of the units relative to the band is provided, usually, an adjustment mechanism for adjusting a cord length is also provided according to a sliding amount of the units. This involves an issue that the size and weight of the band and the units are increased, to thereby deteriorate wearability of the headphone.

It is desirable to provide a headphone capable of reducing in size and weight.

According to an embodiment of the present invention, there is provided a headphone having a band through which a cord connecting a pair of headphone units is inserted, the pair of headphone units being attached to both ends of the band, and at least one of the pair of headphone units being made slidable relative to the band. This headphone includes a hollow slider that supports the slidable headphone unit, accommodates an extension part of the cord for connecting end parts of the band and the slidable headphone unit, and includes an engaged part for regulating a sliding range of the headphone unit in the longitudinal direction of the band; a slider guide fixed to an end part of the band and inserted through the slider for guiding a sliding motion of the slider when the headphone unit is sliding relative to the band; and an engaging part having approximately the same width as the width of the engaged part in a direction orthogonal to the longitudinal axis of the slider, attached to the end part of the band, and engaged with the engaged part so as to be locked to the end part of the engaged part when the headphone unit is sliding relative to the band.

According to this structure, in the headphone unit (also called simply "unit" hereafter) made slidable relative to the band, a sliding range of the slider in the axial direction of the band and rotation of the slider are regulated by the engaging part engaged with the engaged part. In addition, the extension part of the cord is extended/contracted inside of the slider according to the sliding amount of the unit relative to the band. Thus, with a simple structure of the slider, the slider guide, and the engaging part, the sliding mechanism of the unit and the adjustment mechanism of the cord length can be realized, and the size and weight of the headphone itself can be reduced.

In addition, the engaged part may be provided as a slide groove passing through the side face of the slider, and also may be provided as a projection member engaged with the slide groove. Thus, by the projection member engaged with the slide groove provided on the side face of the slider, the sliding range and the rotation of the slider are regulated, and therefore assembling property of the sliding mechanism is improved.

In addition, it may also be preferable to provide an elastic slide regulation part arranged between the slider guide and the slider in a state of being pressed against inner surface of the slider. Thus, the sliding motion of the slider is regulated by elastic friction between the inner surface of the slider and the slide regulation part. Therefore, the adjustment of the sliding amount of the unit relative to the band is facilitated.

In addition, the slide regulation part may be formed integral with the slider guide. Thus, the assembling property of the sliding mechanism is improved.

In addition, the engaged part may be provided as an engaging recess part on the inner surface of the slider, and the engaging part may be provided to the slider guide as the projection part engaged with the engaging recess part. Thus, by the projection part engaged with the engaging recess part provided on the inner surface of the slider, the sliding range and the rotation of the slider are regulated. Therefore, invasion of a substance from outside to inside of the slider through the engaged part such as the slide groove can be prevented.

In addition, the slider guide and/or a cushion may also have a cord insertion hole through which the cord is inserted. Thus, the cord is connected from the end part of the band to the unit through the insertion hole, and therefore the size of a sectional face of the slider can be reduced.

In addition, the extension part of the cord may be formed as a curl cord. Thus, the cord is accommodated in the slider as the curl cord, and therefore the size of the slider can be reduced.

According to the embodiments of the present invention described above, there can be provided the headphone capable of reducing in size and weight.

DETAILED DESCRIPTION OF THE PREFERRED EMBODIMENTS

Figure 1B:
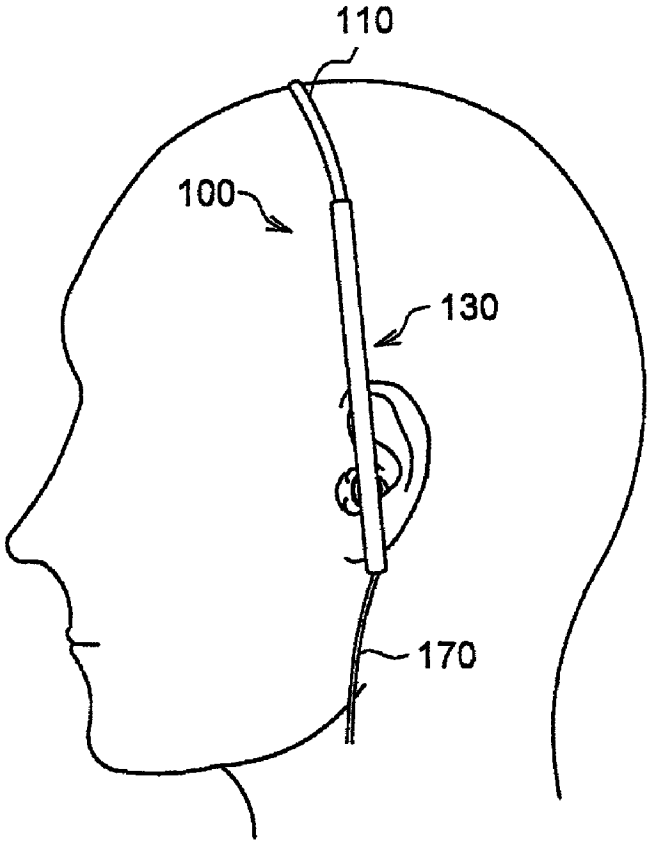
FIG. 1B is an explanatory view illustrating the wearing state of the headphone according to an embodiment of the present invention.

Hereinafter, preferred embodiments of the present invention will be described in detail with reference to the appended drawings. Note that, in the specification and the appended drawings, structural elements that have substantially the same function and structure are denoted with the same reference numerals, and repeated explanation of these structural elements is omitted.

Figure 1A:
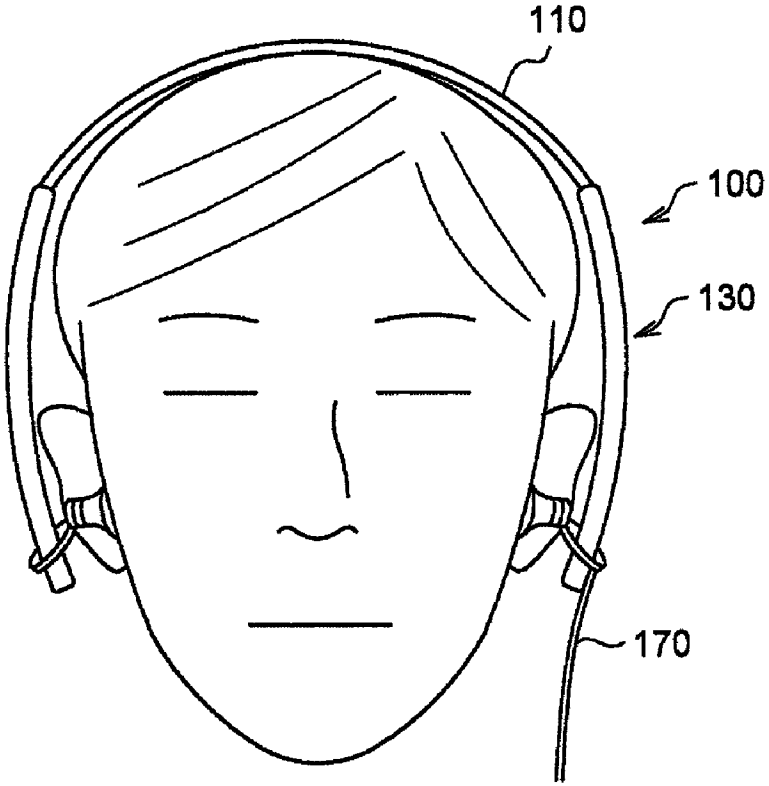
FIG. 1A is an explanatory view illustrating a wearing state of a headphone according to an embodiment of the present invention.

FIG. 1A and FIG. 1B are explanatory views illustrating a wearing state of a headphone 100 according to an embodiment of the present invention. FIG. 1A and FIG. 1B show the headphone 100 of a headband type. FIG. 1A and FIG. 1B show a case of viewing a user wearing the headphone 100 from the front side, and a case of viewing the user wearing the headphone 100 from the left side, respectively.

Explanation will be given for a case in which the present invention is applied to the headphone of the headband type. However, the present invention is not limited to the headphone of the headband type, and for example, the present invention is also applied to the headphone of other type such as a neckband type and an under chin band type, or applied to a headset.

As illustrated in FIG. 1A and FIG. 1B, the headphone 100 has a headband (band) 110 having right and left pair of headphone units 130 (also called simply "units" hereafter) attached to both ends. In the headphone 100, a cord 170 for connecting the pair of the units 130 to each other is inserted through the headband 110, and is led out from one of the units 130 (corresponding to a left side unit in FIG. 1A and FIG. 1B) as a cord with plug.

The headphone 100 has a sliding mechanism in which at least one of the pair of units 130 is made slidable in an axial direction of the headband 110. Note that explanation will be given hereunder for a case in which the headphone 100 has the sliding mechanism wherein both units 130 are made slidable in the axial direction of the headband 110.

The user can improve wearability by adjusting a sliding amount of the units 130 relative to the headband 110, so that a pair of units 130 is positioned at approximately the front faces of right and left auricles, in a state that the headband 110 is worn over the top head part.

Figure 2:
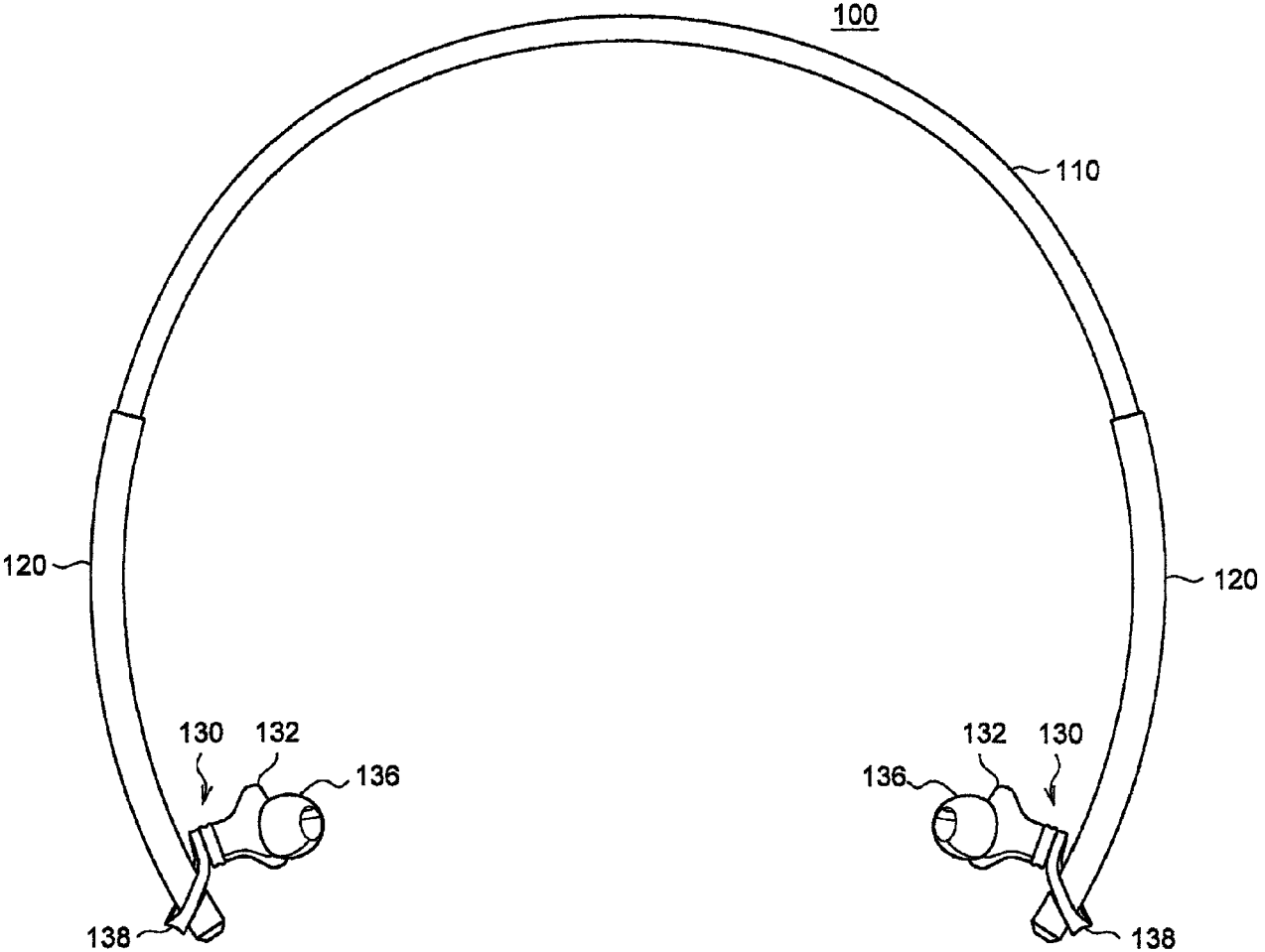
FIG. 2 is a perspective view illustrating an appearance of the headphone.

FIG. 2 is a perspective view illustrating an appearance of the headphone 100. As illustrated in FIG. 2, the headphone 100 includes an approximately U-shaped headband 110, a pair of sliders 120 (also called hangers) attached to both ends of the headband 110, and a pair of units 130 supported by the pair of sliders 120.

The headband 110 has flexibility and is adjustable in a predetermined range of a linear distance between the both ends. One end of the sliders 120 supports the units 130 and the other end is slidably attached to the end part of the headband 110. Each unit 130 includes a housing 132 that accommodates a driver unit (not shown) including a speaker, a sound guiding tube 134 protruded from the housing 132 at a predetermined angle, and an elastic earpiece 136 attached to the tip end of the sound guiding tube 134 (see FIG. 7). Note that the sound guiding tube 134 and the earpiece 136 may be omitted, and either one of the sound tube 134 and the earpiece 136 may be omitted. Each unit 130 is supported by one end of the slider 120 via an arm part 138 provided to the housing 132.

Figure 3:
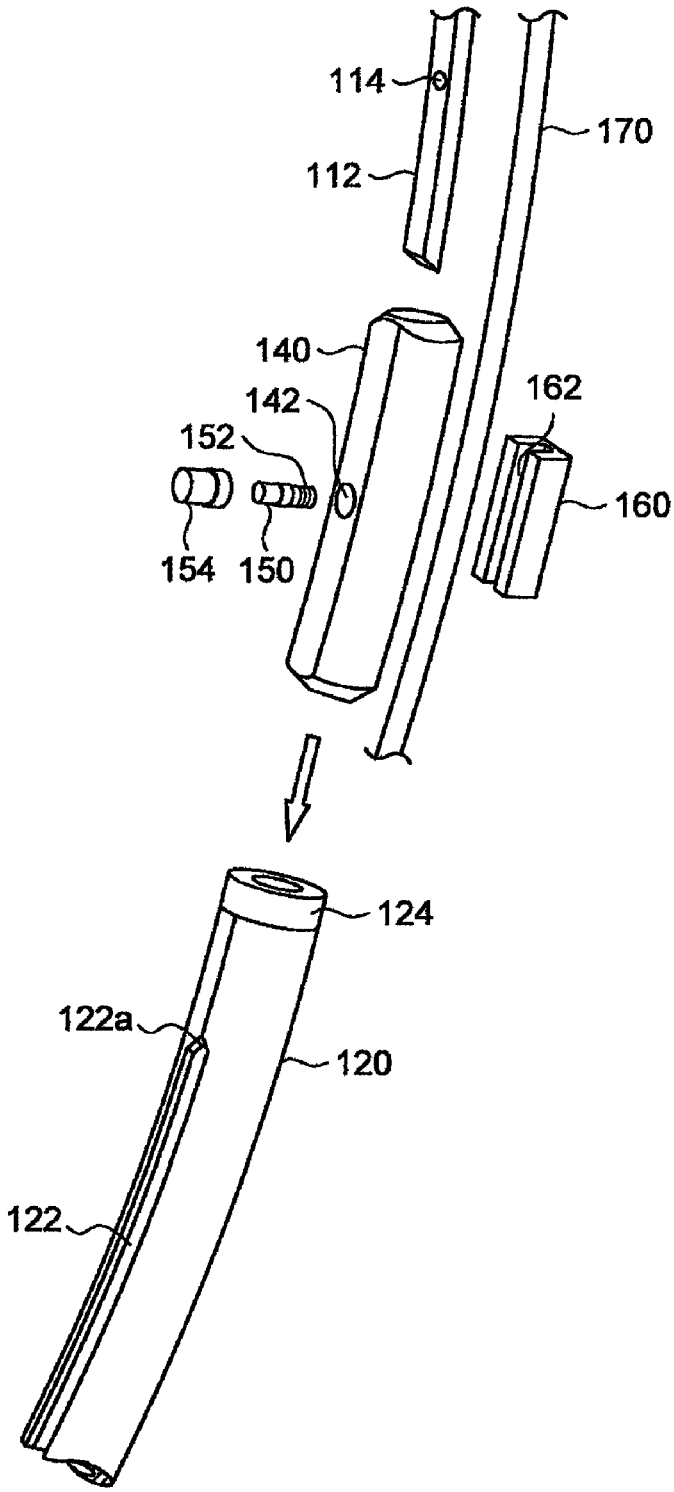
FIG. 3 is an explanatory view illustrating a sliding mechanism of the headphone.
Figure 4A:
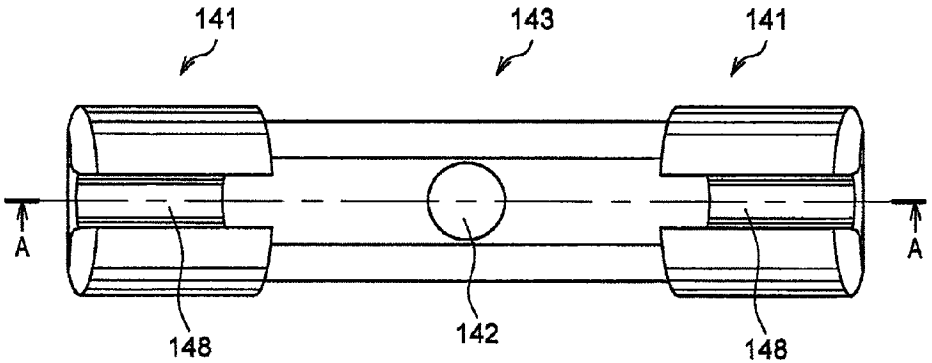
FIG. 4A is an explanatory view illustrating details of a slider guide.
Figure 4B:
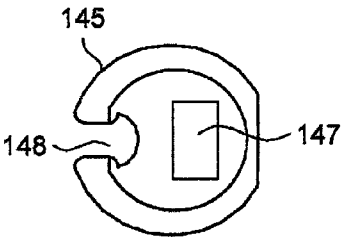
FIG. 4B is an explanatory view illustrating the details of the slider guide.
Figure 4C:
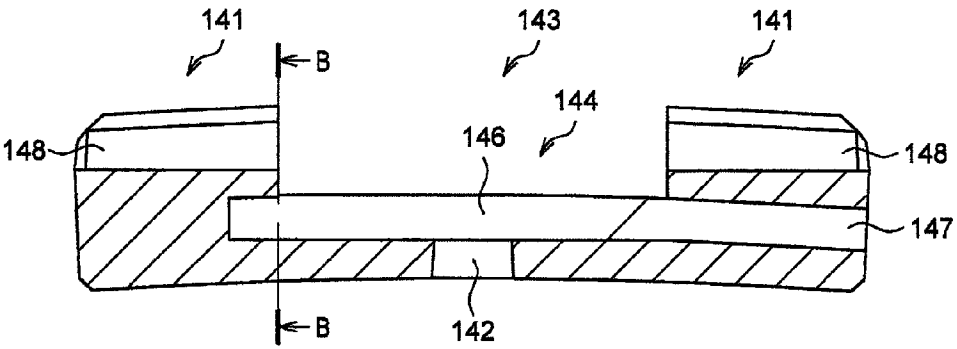
FIG. 4C is an explanatory view illustrating the details of the slider guide.
Figure 4D:
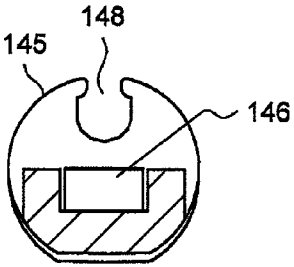
FIG. 4D is an explanatory view illustrating the details of the slider guide.

FIG. 3 is an explanatory view illustrating the sliding mechanism of the headphone 100. FIG. 3 shows an exploded perspective view of constituent elements of the sliding mechanism.

As illustrated in FIG. 3, the sliding mechanism includes a band member 112 inserted through the headband 110, a slider 120, a slider guide 140, a stopper (engaging part) 150, a stopper ring 154, a cushion (slide regulation part) 160, and a cord 170. Note that in the description hereunder, a material of each member constituting the sliding mechanism is exemplified, but the material of each member is not limited thereto.

The band member 112 is formed as a thin plate-like member or a bar-like member having flexibility such as stainless steel. A female screw 114 to be engaged with a male screw 152 formed on one end of the stopper 150 is provided on the end part of the band member 112. In addition, when the band member 112 is constituted of a hard material, the band member 112 may be further covered with a soft material to improve the wearability over a head part. Note that the band member 112 may also be constituted of resin, for example, instead of being constituted of metal.

The slider 120 is formed as a cylindrical member having a predetermined inner diameter, such as aluminum. The slider 120 includes a linear slide groove 122 having both end parts 122*a* and 122*b* (see FIG. 7) in the axial direction of the slider 120, with a predetermined groove width. Also, an annular cap 124 is attached to the end part attached to the headband 110. Note that the inner diameter of the slider 120 is determined so as to approximately correspond to the diameter of a curl cord 175 as will be described later.

By forming the slider 120 as a cylindrical member, processing of the slider 120 is facilitated, and a contact surface with an auricle, etc, is curved to thereby ensure wearability. In addition, a predetermined internal cross section can be easily obtained, and therefore the size and weight of the slider 120 itself and also the size and weight of the headphone 100 itself can be reduced. However, a sectional shape of the slider 120 is not limited to a cylindrical shape.

The slider guide 140 is made of, for example, resin, and is formed as an approximately cylindrical member having an outer diameter approximately corresponding to the inner diameter of the slider 120. The slider guide 140 includes, although details will be described later, a stopper through hole 142 through which the stopper 150 is passed, a cushion storage part 144 for storing the cushion 160, a band storage part 146 for storing the end part of the band member 112, and a cord through hole 148 through which the cord 172 is passed (see FIGS. 4A, 4B, 4C, 4D).

The stopper 150 is made of, for example steel, and is formed as a projection member having approximately the same width as the groove width of the slide groove 122. The male screw 152 to be engaged with the female screw 114 of the band member 112 is formed on one end of the stopper 150. The stopper 150 has a length long enough to lock its one end to the end parts 122*a*, 122*b* of the slide groove 122, with the other end engaged, through the slide groove 122, with the female screw 114 of the band member 112 which is inserted through the slider 120.

Note that when a predetermined shear strength can be ensured by the stopper 150 during sliding, and the size of the slider 120 can be reduced, the stopper 150 may be engaged with the band member 112 not by screws but by caulking, etc.

The stopper ring 154 is formed by fluorine coating applied to the stopper 150, for example, and is formed so as to coat the stopper 150. The stopper ring 154 functions to prevent damage and wear of the stopper 150 due to contact with the slide groove 122 when the stopper 150 moves along the slide groove 122.

The cushion 160 is made of, for example rubber, and is formed as an approximately semi-circular sectional member approximately corresponding to the shape of the cushion storage part 144 of the slider guide 140. As will be described in detail later, the cushion 160 includes a cord insertion hole 162 through which a cord 172 is inserted, and a contact surface 165 (see FIGS. 5A, 5B, 5C) with the inner surface of the slider.

A cord 170 is formed by including twin core wiring composed of a signal line and a ground line. As will be described later, the cord 170 includes a part 170 inserted through the headband 110, and a connection part 174 (see FIG. 6A) for connecting parts 172 positioned at the end parts of the headband 110, and the units 130.

Figure 5A:
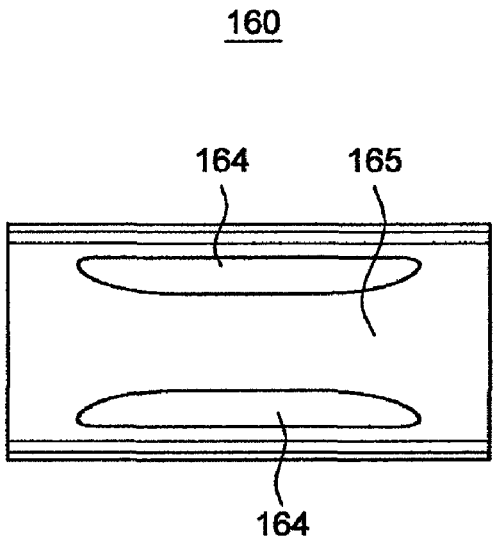
FIG. 5A is an explanatory view illustrating the details of a cushion.
Figure 5B:
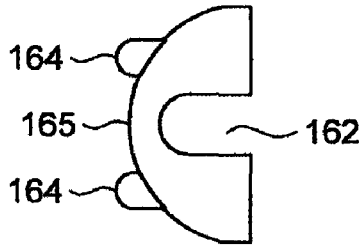
FIG. 5B is an explanatory view illustrating the details of the cushion.
Figure 5C:
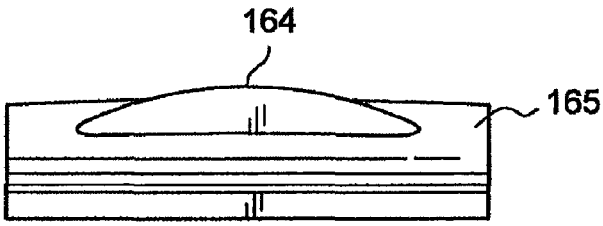
FIG. 5C is an explanatory view illustrating the details of the cushion.

FIGS. 4A, 4B, 4C, and 4D are explanatory views illustrating the details of the slider guides 140, and FIGS. 5A, 5B, and 5C are explanatory views illustrating the details of the cushion 160. FIGS. 4A, 4B, 4C, and 4D illustrate a plan view, a right side view, a sectional view taken along the line A-A, and the sectional view taken along the line B-B of the slider guides 140, respectively. FIGS. 5A, 5B, and 5C illustrate a plan view, a right side view, and a front side view of the cushion 160, respectively.

As illustrated in FIGS. 4A, 4B, 4C, and 4D, the slider guides 140 include both end parts 141 having an approximately circular-shaped sectional face, and a center part 143 having an approximately U-shaped sectional face.

Cord insertion holes 148 having approximately circular sectional shapes, through which the cords 172 are inserted, are provided on outer surfaces of the both end parts 141 in the axial direction. A band communication hole 147 having a rectangular sectional shape for communicating the end part of the band member 112 with the band storage part 146, is provided inside of one end part in the axial direction. The both end parts 141 having sectional shapes approximately corresponding to the internal sectional shapes of the sliders 120 have contact surfaces 145 with the inner surfaces of the sliders 120.

A stopper through hole 142, through which a stopper 150 is passed, is provided on the bottom surface of the center part 143. The center part 143 includes the cushion storage part 144 for storing the cushion 160, and the band storage part 146 for storing the end part of the band member 112.

As illustrated in FIGS. 5A, 5B, and 5C, the cushion 160 includes the cord insertion hole 162 having approximately the circular sectional shape, through which the cord 172 is inserted. The cushion 160 having the sectional shape approximately corresponding to a part of the internal sectional shape of the slider 120, has a contact surface 165 with the inner surface of the slider 120. In addition, a projection 164 is axially provided in the cushion 160, for surely providing a friction between the cushion 160 and the inner surface of the slider 120.

Here, the cushion 160 is formed so as to cause elastic friction between the contact surface 165 (and projection 164) and the inner surface of the slider 120, when the slider 120 is sliding relative to the slider guide 140, with the cushion 160 stored in the slider guide 140 together with the end part of the band member 112 and the cord 172.

Here, if elasticity of the material is the same, the cushion 160 regulates the sliding of the slider 120 relative to the slider guide 140 excellently if the sectional shape is greater. Therefore, by providing the band storage part 146 and the cord insertion hole 148, thereby efficiently utilizing the limited internal sectional face within the slider 120, the storage space of the cushion 160 is ensured.

Note that when the elastic friction between the contact surface and the inner surface of the slider 120 can be sufficiently ensured only by the contact surface 145 of the slider guide 140, the cushion 160 may be omitted. In this case, the cushion storage part 144 is not required to be provided in the center part of the slider guide 140. In addition, instead of constituting the cushion 160 separately from the slider guide 140, it may be constituted integrally with the slider guide 140.

Figure 6A:
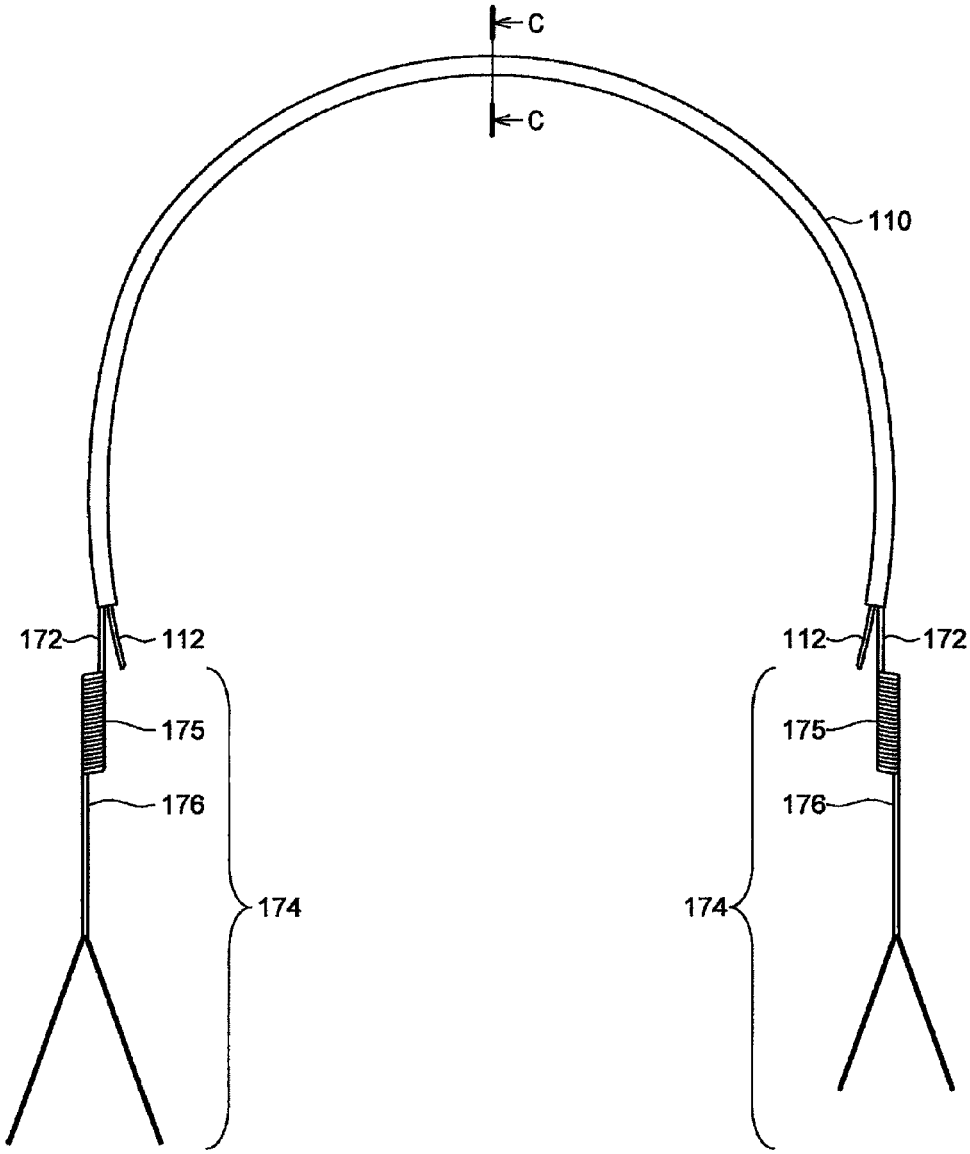
FIG. 6A is an explanatory view illustrating the details of a headband and a cord.
Figure 6B:
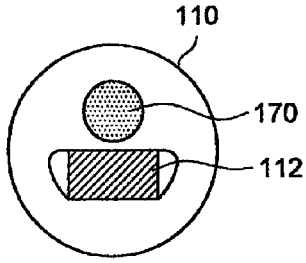
FIG. 6B is an explanatory view illustrating the details of the headband and the cord.

FIGS. 6A and 6B are explanatory views illustrating the details of the headband 110 and the cord 170. FIGS. 6A and 6B are a plan view and a sectional view taken along the line C-C of the headband 110 and the cord 170, respectively.

FIG. 6B illustrates sectional faces of the band member 112 and the cord 170 covered with tube. The band member 112 is covered with extruded tube together with the cord 170. Note that when frictional deterioration of a coating material can be suppressed at the time of sliding by ensuring a suitable coating thickness, the band member 112 and the cord 170 may be covered with heat shrinkable tube instead of the extruded tube.

The cord 170 inserted through the headband 110 is constituted of twin-core wiring composed of one signal line and one ground line corresponding to the units 130 on the side where no cord is led out (corresponding to the right side unit in FIGS. 1A and 1B). The cord 170 inserted through the headband 110 is coated, as described above, together with the band member 112.

The connection part 174, which connects the parts 172 positioned on the end parts of the headband 110 and the units 130, is provided on the end parts of the cord 170 inserted through the headband 110. The connection part 174 of the cord is composed of an extension part 175 accommodated inside of the sliders 120 as a freely extended and contracted curl cord, and a leading-out part 176 led out to outside of the slider 120 and connected to the units 130.

In the unit 130 on the side where the cord is led out (corresponding to the left side unit in FIGS. 1A and 1B), a triple-core cord having three cores such as the signal line of the right side unit 130, one ground line, and the signal line of the left side unit 130, which are inserted through the headband 110, is led out and connected to an electronic apparatus, etc, via a plug (not shown), and so forth.

Figure 7:
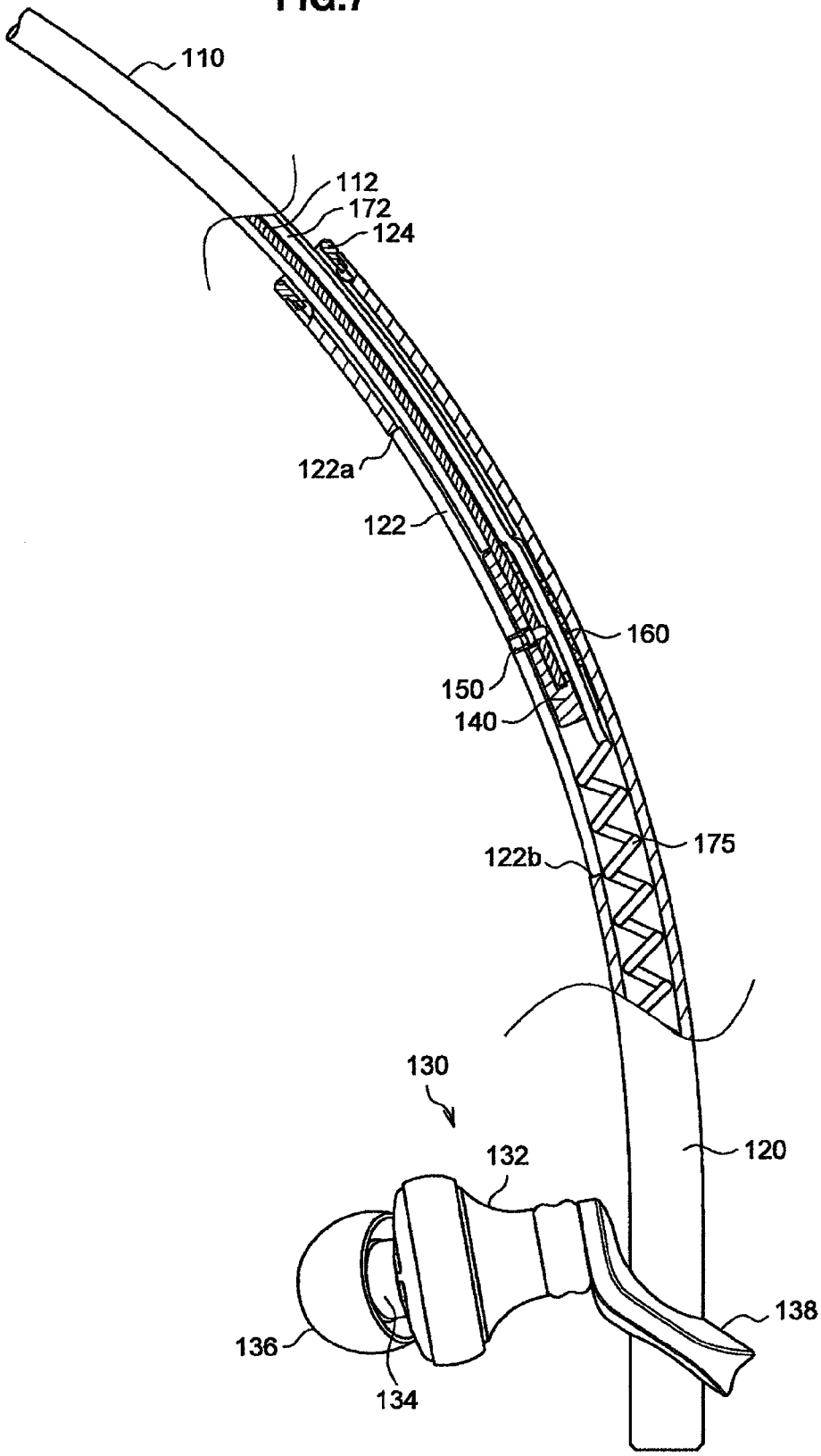
FIG. 7 is an explanatory view illustrating the details of the sliding mechanism of the headphone.
Figure 8A:
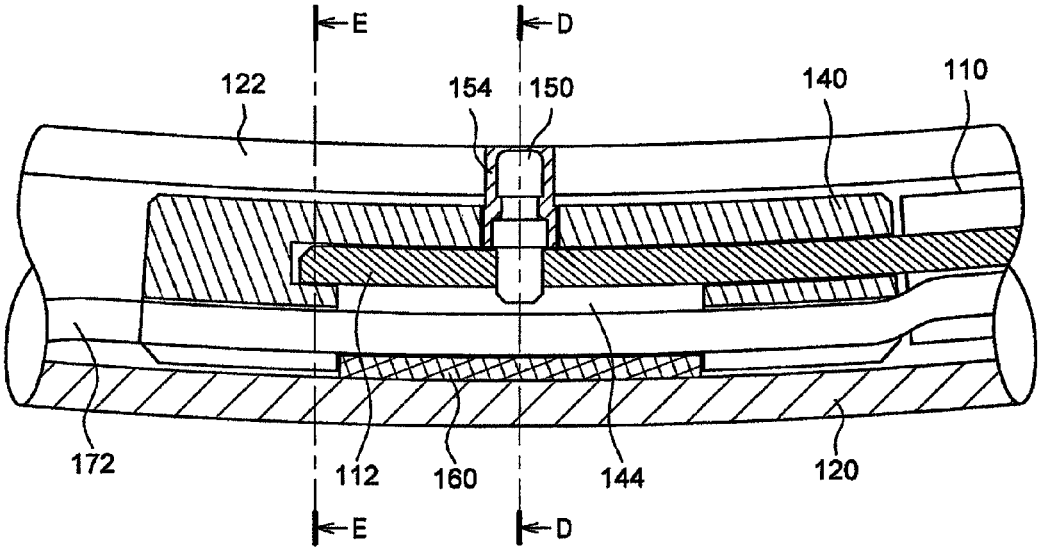
FIG. 8A is an explanatory view illustrating the details of the sliding mechanism of the headphone.
Figure 8B:
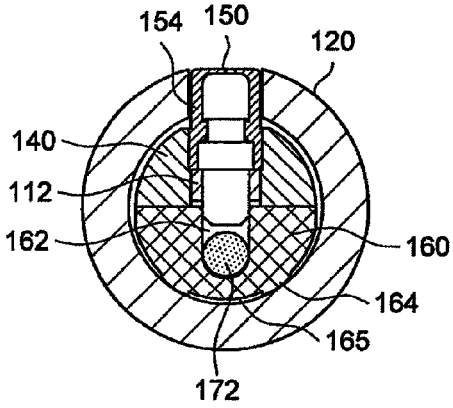
FIG. 8B is an explanatory view illustrating the details of the sliding mechanism of the headphone.
Figure 8C:
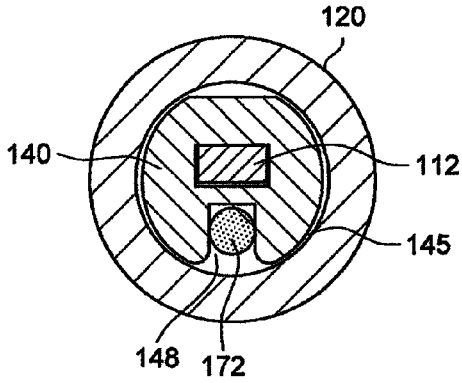
FIG. 8C is an explanatory view illustrating the details of the sliding mechanism of the headphone.

FIGS. 7 and 8A, 8B, 8C are explanatory views illustrating details of a sliding mechanism of the headphone 100. FIGS. 7 and 8 illustrate an end part of the headband 110 and an internal structure of the slider 120, FIG. 7 is a partial sectional view illustrating the sliding mechanism, and FIGS. 8A, 8B, 8C are expanded sectional views illustrating essential parts of the sliding mechanism. In addition, FIGS. 8A, 8B, 8C illustrate an expanded view of the essential parts of the sliding mechanism, a sectional view taken along the line D-D, and a sectional view taken along the line E-E, respectively.

As illustrated in FIGS. 7 and 8A, 8B, 8C, in the sliding mechanism, the cushion 160 is attached to the cushion storage part 144 of the slider guide 140, with the cord 172 inserted through the cord insertion hole 148 of the slider guide 140, and the cord 172 inserted through the cord insertion hole 162 of the cushion 160. Then, the end part of the band member 112 is passed through the band communication hole 147 of the slider guide 140, to be attached to the band storage part 146.

The slider guide 140 attached to the tip end of the band member 112 is inserted through the slider 120 together with the cord 172 and the cushion 160, so that the stopper through hole 142 of the slider guide 140 is positioned on the slider groove 122 of the slider 120. Here, the elastic friction occurs between the inner surface of the slider 120 and the contact surface 165 of the cushion 160 (including the projection 164), for regulating the sliding motion of the slider guide 140 relative to the slider 120. Then, the male screw 152 of the stopper 150 covered with the stopper ring 154 is engaged with the female screw 114 of the band member 112 through the slide groove 122. Here, the stopper 150 has approximately the same width as that of the slide groove 122, and is engaged with the female screw 114 of the band member 112 so as to be locked to the end parts 122*a* and 122*b* of the slide groove 122, when the slider 120 is sliding relative to the slider guide 140.

Figure 9A:
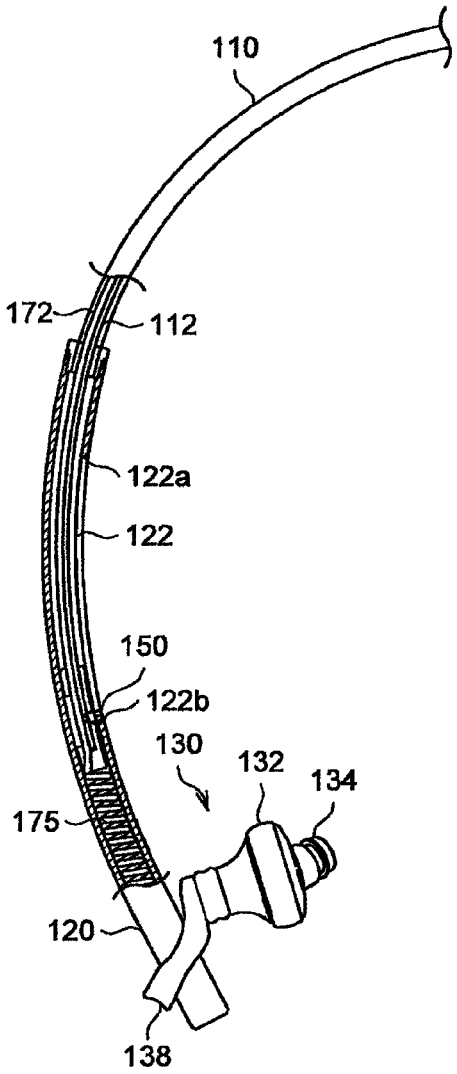
FIG. 9A is an explanatory view illustrating an operation state of the sliding mechanism.
Figure 9B:
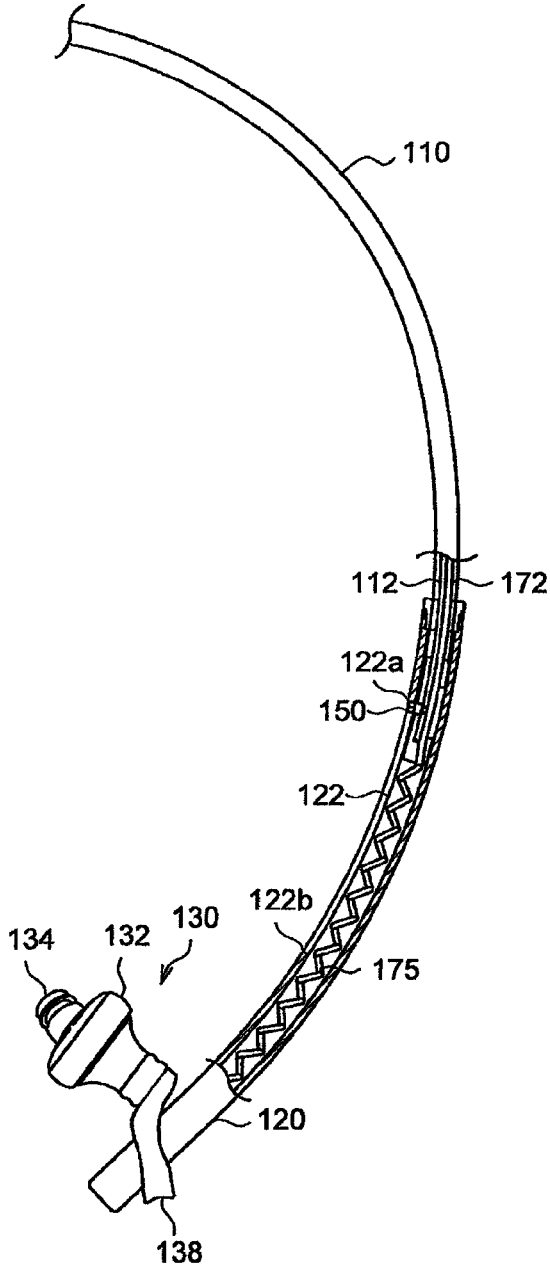
FIG. 9B is an explanatory view illustrating the operation state of the sliding mechanism.

FIGS. 9A and 9B are explanatory views illustrating an operation state of the sliding mechanism. FIGS. 9A and 9B illustrate a state in which the slider 120 is made to slide so that the unit 130 is positioned closer to the tip end parts of the headband 110, and also illustrate a state in which the slider 120 is made to slide so that the unit 130 is positioned farther from the tip end of the headband 110.

In FIG. 9A, by locking the stopper 150 to one end 122*b* closer to the unit 130 in the slide groove 122, the sliding range of the slider 120 relative to the headband 110 is regulated. In addition, by extension of the curl cord 175 inside of the slider 120, a cord length is adjusted according to the sliding amount of the unit 130. Meanwhile, in FIG. 9B, by locking the stopper 150 to the other end 122*a* on the side farther from the unit 130 in the slide groove 122, the sliding range of the slider 120 relative to the headband 110 is regulated. Further, by extending the curl cord 175 inside of the slider 120, the cord length is adjusted according to the sliding amount of the unit 130.

As described above, according to the headphone 100 of the present embodiment, the sliding range and the rotation of the slider 120 in the axial direction of the headband 110 is regulated by the stopper 150 engaged with the slide groove 122, when the sliding amount of the units 130 relative to the headband 110 is adjusted.

Namely, when the stopper 150 is moved along the slide groove 122 and locked to the end parts 122*a* and 122*b* of the slide groove 122, the sliding range of the slider 120 is regulated, to prevent falling-off of the slider 120 from the headband 110. In addition, the rotation of the slider guide 140 is regulated by contact of the stopper 150 with the slider 120 (side face of the slide groove 122) in a direction orthogonal to the axis of the slider 120, and the deterioration of the wearability due to change of a protruding direction of the sound guiding tube 134 with respect to the auricle is prevented or breakage of the cord 170 is prevented.

In addition, by regulating the sliding motion of the slider 120 relative to the slider guide 140 by the elastic friction between the inner surface of the slider 120 and at least the contact surface 165 of the cushion 160 (including projection 164), the adjustment of the sliding amount of the units 130 relative to the headband 110 is facilitated. In this case, stepless adjustment of the sliding amount is possible.

Further, by extension of the curl cord 175 inside of the slider 120 according to the sliding amount of the units 130 relative to the headband 110, the adjustment mechanism of the cord length is realized. In this case, the curl cord 175 is not exposed to outside, and therefore deterioration of the cord 170 (172, 174) due to dirt and grime can be prevented.

Therefore, according to the headphone 100 of this embodiment, the sliding mechanism of the units 130 and the adjustment mechanism of the cord length can be realized, with a simple structure of the slider 120, the slider guide 140, the stopper 150 (selectively including the cushion 160), and the size and weight of the headphone 100 itself can be reduced.

Although a preferred embodiment of the present invention is described in the foregoing with reference to the drawings, the present invention is not limited thereto. It should be understood by those skilled in the art that various modifications, combinations, sub-combinations and alterations may occur depending on design requirements and other factors insofar as they are within the scope of the appended claims or the equivalents thereof.

For example, according to the above-described embodiment, explanation is given for the case that the sliding mechanism includes the slide groove 122 passing through the side face of the slider 120, and the stopper 150 engaged with the slide groove 122. In this case, the stopper 150 is fastened to the band member 112 through the slide groove 122, and therefore assembly is facilitated.

Figure 10A:
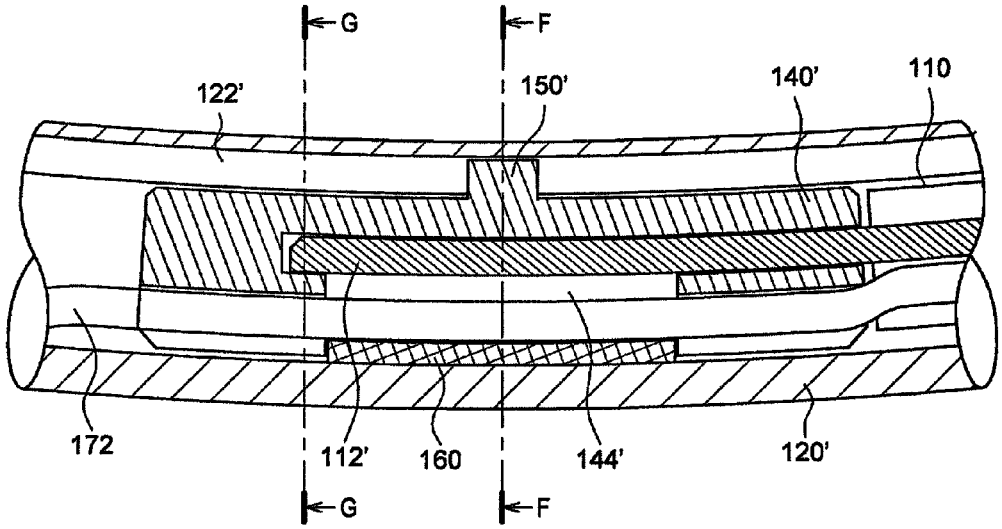
FIG. 10A is an explanatory view illustrating the details of a modified example of the sliding mechanism.
Figure 10B:
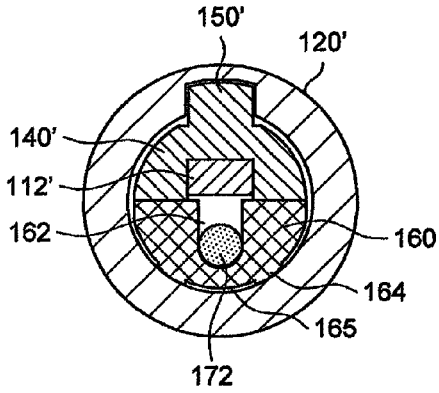
FIG. 10B is an explanatory view illustrating the details of the modified example of the sliding mechanism.
Figure 10C:
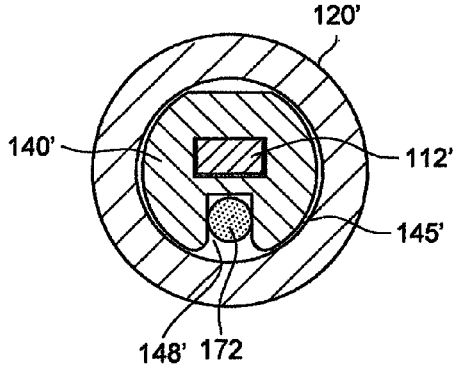
FIG. 10C is an explanatory view illustrating the details of the modified example of the sliding mechanism.

FIGS. 10A, 10B, and 10C are explanatory views illustrating details of modified examples of the sliding mechanism. FIGS. 10A, 10B, and 10C illustrate one end of the headband 110 and the internal structure of a slider 120', and FIGS. 10A, 108, and 10C illustrate an expanded view of essential parts according to the modified examples of the sliding mechanism, a sectional view taken along the line F-F, and a sectional view taken along the line G-G, respectively.

The sliding mechanism may also include an engaging recess part 122' formed on the inner surface of the slider 120', and a projection part 150' provided in a slider guide 140' and engaged with the engaging recess part 122'. Note that similarly to the slide groove 122, in the engaging recess part 122', the end parts 122*a'* and 122*b'* (not shown) are provided in the axial direction of the slider 120'. In this case, the tip end of a band member 112' is stored in a band storage part 146' of the slider guide 140' by a fixing unit such as bonding.

Then, when the slider 120' performs sliding, by locking the protruding part 150' to the end parts 122*a'* or 122*b'*, the sliding range of the slider 120' in the axial direction is regulated. Also, by making the protruding part 150' engage with the engaging recess part 122', the rotation of the slider 120' is regulated. Thus, the sliding mechanism is constituted without providing an opening on the side face of the slider 120', and therefore invasion of a substance to inside from outside of the sliders 120 through the slide groove 122 can be prevented.

In addition, in the above-described embodiment, explanation is given for the case in which the multistep adjustment is possible for the sliding amount of the units 130 relative to the headband 110 by the sliding mechanism. However, the stepless adjustment of the sliding amount of the units 130 relative to the headband 110 may also be possible by providing irregularities in the width of the slide groove 122 at predetermined intervals.

What is claimed is:

1. A headphone having a band through which a twin-cord wiring connecting a pair of headphone units is inserted, the pair of headphone units being attached to both ends of the headphone, and at least one of the pair of headphone units being made slidable relative to the band, comprising:

a hollow slider that supports the slidable headphone unit, accommodates an extension part of the twin-cord wiring for connecting wiring positioned at the end of the band with the slidable headphone unit, and includes an engaged part for regulating a sliding range of the headphone unit in the longitudinal direction of the band;

a slider guide fixed to an end part of the band and inserted through the slider, for guiding a sliding motion of the slider when the headphone unit is sliding relative to the band, wherein the sliding motion is regulated by friction and is stepless; and an engaging part having approximately the same width as the width of the engaged part in a direction orthogonal to the longitudinal axis of the slider, attached to the end part of the band, and engaged with the engaged part so as to be locked to the end part of the engaged part when the headphone unit is sliding relative to the band.

2. The headphone according to claim 1, wherein the engaged part is provided as a slide groove passing through a side face of the slider, and the engaging part is provided as a projection member engaged with the slide groove.

3. The headphone according to claim 2, wherein an elastic slide regulation part is further disposed between the slider guide and the slider, in a state of being pressed against an inner surface of the slider.

4. The headphone according to claim 3, wherein the slide regulation part is made integral with the slider guide.

5. The headphone according to claim 1, wherein the engaged part is provided on an inner surface of the slider as an engaging recess part, and the engaging part is provided in the slider guide as a projection part engaged with the engaging recess part.

6. The headphone according to claim 1, wherein a cord insertion hole through which the twin-cord wiring is inserted is provided in the slider guide.

7. The headphone according to claim 3, wherein a cord insertion hole through which twin-cord wiring is inserted is provided in the slide regulation part.

8. The headphone according to claim 1, wherein the extension part of the twin-cord is formed as a curl cord.

9. The headphone according to claim 8, wherein the curl cord portion of the twin cord is configured to extend when the headphone unit is moved away from the band, and configured to contract when the headphone unit is moved toward the band.

10. The headphone according to claim 1, wherein the friction regulating the sliding motion is between the surface of the slider guide and the internal surface of the slider.

11. The headphone according to claim 3, wherein the friction regulating the sliding motion is between the surface of the elastic slide regulation part and the internal surface of the slider.

12. The headphone according to claim 1, where both headphone units of said pair of headphone units are made slidable relative to the band.

13. A headphone having a band through which a twin-cord wiring connecting a pair of headphone units is inserted, the pair of headphone units being attached to both ends of the headphone, and at least one of the pair of headphone units being made slidable relative to the band, comprising:

a hollow slider that supports the slidable headphone unit, accommodates an extension part of the twin-cord wiring for connecting wiring positioned at the end of the band with the slidable headphone unit, and includes an engaged part for regulating a sliding range of the headphone unit in the longitudinal direction of the band;

a slider guide fixed to an end part of the band and inserted through the slider, for guiding a sliding motion of the slider when the headphone unit is sliding relative to the band, wherein the sliding motion is regulated by friction; and an engaging part having approximately the same width as the width of the engaged part in a direction orthogonal to the longitudinal axis of the slider, attached to the end part of the band, and engaged with the engaged part so as to be locked to the end part of the engaged part when the headphone unit is sliding relative to the band, wherein:

the engaged part is provided as a slide groove passing through a side face of the slider;

the engaging part is provided as a projection member engaged with the slide groove;

an elastic slide regulation part is further disposed between the slider guide and the slider, in a state of being pressed against an inner surface of the slider; and the friction regulating the sliding motion is between the surface of the elastic slide regulation part and the internal surface of the slider.

14. The headphone according to claim 13, wherein the slide regulation part is made integral with the slider guide.

15. The headphone according to claim 13, wherein the engaged part is provided on an inner surface of the slider as an engaging recess part, and the engaging part is provided in the slider guide as a projection part engaged with the engaging recess part.

16. The headphone according to claim 13, wherein a cord insertion hole through which the twin-cord wiring is inserted is provided in the slider guide.

17. The headphone according to claim 13, wherein a cord insertion hole through which twin-cord wiring is inserted is provided in the slide regulation part.

18. The headphone according to claim 13, wherein the extension part of the twin-cord is formed as a curl cord.

19. The headphone according to claim 18, wherein the curl cord portion of the twin cord is configured to extend when the headphone unit is moved away from the band, and configured to contract when the headphone unit is moved toward the band.

20. The headphone according to claim 13, wherein the friction regulating the sliding motion is between the surface of the slider guide and the internal surface of the slider.

21. The headphone according to claim 13, where both headphone units of said pair of headphone units are made slidable relative to the band.

* * * * *